US012305453B2

(12) United States Patent
Morrison

(10) Patent No.: US 12,305,453 B2
(45) Date of Patent: May 20, 2025

(54) CASING SHOE ASSEMBLY

(71) Applicant: FORUM US, INC., Houston, TX (US)

(72) Inventor: Jeffery Morrison, Missouri City, TX (US)

(73) Assignee: FORUM US, INC., Houston, TX (US)

( * ) Notice: Subject to any disclaimer, the term of this patent is extended or adjusted under 35 U.S.C. 154(b) by 0 days.

(21) Appl. No.: 18/529,881

(22) Filed: Dec. 5, 2023

(65) Prior Publication Data

US 2024/0183231 A1 Jun. 6, 2024

Related U.S. Application Data

(60) Provisional application No. 63/430,550, filed on Dec. 6, 2022.

(51) Int. Cl.

| | |
|---|---|
| ***E21B 17/14*** | (2006.01) |
| ***E21B 7/06*** | (2006.01) |
| ***E21B 17/10*** | (2006.01) |
| ***E21B 33/14*** | (2006.01) |
| ***E21B 34/10*** | (2006.01) |
| ***E21B 41/00*** | (2006.01) |

(52) U.S. Cl.

CPC ..... *E21B 17/14* (2013.01); *E21B 7/061* (2013.01); *E21B 17/1035* (2013.01); *E21B 33/14* (2013.01); *E21B 34/10* (2013.01); *E21B 41/0035* (2013.01)

(58) Field of Classification Search

CPC ..... E21B 17/14; E21B 17/1035; E21B 7/061; E21B 7/00; E21B 33/14; E21B 41/0035; E21B 34/10; E21B 21/10

See application file for complete search history.

(56) References Cited

U.S. PATENT DOCUMENTS 2,492,079 A * 12/1949 Wiley ..... E21B 7/061 166/117.5
3,330,349 A * 7/1967 Owsley ..... E21B 7/061 166/313

(Continued)

FOREIGN PATENT DOCUMENTS

| | | |
|---|---|---|
| EP | 0859119 A2 | 8/1998 |
| GB | 2443942 A | 5/2008 |

OTHER PUBLICATIONS

PCT International Search Report and Written Opinion dated Mar. 12, 2024, for International Application No. PCT/US2023/082559.

*Primary Examiner* — George S Gray

(74) *Attorney, Agent, or Firm* — Patterson + Sheridan, LLP

(57) ABSTRACT

Casing shoe assemblies that are configured to direct the drilling of multiple wellbores below a single primary wellbore. The casing shoe assembly has an outer housing and an inner body at least partially disposed within the outer housing that is formed out of a drillable material. The inner body has a bore formed through the inner body. A check valve assembly is disposed within the bore of the inner body. A guide plate is disposed within the outer housing above the inner body and has a plurality of wellbore openings and a separate opening formed through the guide plate to provide fluid flow into the bore formed through the inner body. A wellbore guide is located below each wellbore opening of the guide plate and within a hole formed in the inner body. Each wellbore guide and each hole does not extend through the entire inner body.

16 Claims, 3 Drawing Sheets

(56) References Cited

U.S. PATENT DOCUMENTS

| | | | | | |
|---|---|---|---|---|---|
| 4,573,541 | A * | 3/1986 | Josse | E21B 7/061 | 166/117.5 |
| 5,330,007 | A * | 7/1994 | Collins | E21B 7/068 | 166/341 |
| 5,462,120 | A * | 10/1995 | Gondouin | E21B 7/061 | 166/380 |
| 5,697,442 | A * | 12/1997 | Baldridge | E21B 17/10 | 166/241.1 |
| 6,142,235 | A * | 11/2000 | Monjure | E21B 7/043 | 166/313 |
| 6,244,342 | B1 * | 6/2001 | Sullaway | E21B 33/14 | 166/318 |
| 10,941,622 | B2 | 3/2021 | Lambert et al. | | |
| 2008/0110625 | A1 * | 5/2008 | Arcement | E21B 33/14 | 166/285 |
| 2016/0208586 | A1 | 7/2016 | Perschke et al. | | |
| 2020/0232289 | A1 | 7/2020 | Lambert et al. | | |
| 2020/0386074 | A1 * | 12/2020 | Morrison | E21B 34/10 | |

* cited by examiner

CASING SHOE ASSEMBLY

CROSS-REFERENCE TO RELATED APPLICATIONS

This application claims benefit of U.S. provisional patent application Ser. No. 63/430,550, filed Dec. 6, 2022, which is herein incorporated by reference in its entirety.

BACKGROUND

Field

Aspects of the present disclosure relate to a casing shoe assembly configured to direct a drill string for drilling multiple wellbores through the casing shoe.

Description of the Related Art

As the cost of wellbore drilling continues to rise, operators are continuously seeking cost saving tools and methods. One such method is to drill as many wellbores as possible within a given limited drilling area. However, existing systems are inadequate in their ability to place drill strings and/or casing strings in a safe way where multiple and robust wellbores can be drilled within a small drilling area during drilling operations.

Therefore, there is a continuous need for new and/or improved tools and methods for wellbore drilling.

SUMMARY

In one embodiment, a casing shoe assembly comprises an outer housing; an inner body at least partially disposed within the outer housing and formed out of a drillable material, the inner body comprising a bore formed through the inner body; a check valve assembly disposed within the bore of the inner body and configured to allow fluid flow in one direction and prevent fluid flow in the opposite direction; a guide plate disposed within the outer housing above the inner body having a plurality of wellbore openings formed through the guide plate and a separate opening formed through the guide plate to provide fluid flow into the bore formed through the inner body; and a wellbore guide located below each wellbore opening of the guide plate and within a hole formed in the inner body, wherein each wellbore guide and each hole does not extend through the entire inner body.

In one embodiment, a method of drilling a wellbore comprises lowering a casing string comprising a casing shoe assembly into a primary wellbore, wherein the casing shoe assembly comprises: an outer housing; an inner body at least partially disposed within the outer housing and formed out of a drillable material, the inner body comprising a bore formed through the inner body; a check valve assembly disposed within the bore of the inner body and configured to allow fluid flow in one direction and prevent fluid flow in the opposite direction; a guide plate disposed within the outer housing above the inner body having a plurality of wellbore openings formed through the guide plate and a separate opening formed through the guide plate to provide fluid flow into the bore formed through the inner body; and a wellbore guide located below each wellbore opening of the guide plate and within a hole formed in the inner body, wherein each wellbore guide and each hole does not extend through the entire inner body; cementing the casing string in the primary wellbore by flowing cement through the casing string, through the bore of the inner body, and out of the casing shoe assembly into the primary wellbore; lowering a drill string through the casing string; directing the drill string into one of the plurality of wellbore openings of the guide plate and through the wellbore guide located below the wellbore opening; drilling through the inner body and out of the casing shoe assembly to drill a first wellbore below the primary wellbore; lowering the same or a different drill string through the casing string; directing the same or the different drill string into one of the other plurality of wellbore openings of the guide plate and through the wellbore guide located below the wellbore opening; and drilling through the inner body and out of the casing shoe assembly to drill a second wellbore below the primary wellbore.

BRIEF DESCRIPTION OF THE DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

The disclosure contemplates that terms such as "couples," "coupling," "couple," and "coupled" may include but are not limited to welding, interference fitting, and/or fastening such as by using bolts, threaded connections, pins, clips, and/or screws. The disclosure contemplates that terms such as "couples," "coupling," "couple," and "coupled" may include but are not limited to integrally forming. The disclosure contemplates that terms such as "couples," "coupling," "couple," and "coupled" may include but are not limited to direct coupling and/or indirect coupling, such as indirect coupling through components such as links.

Figure 1:
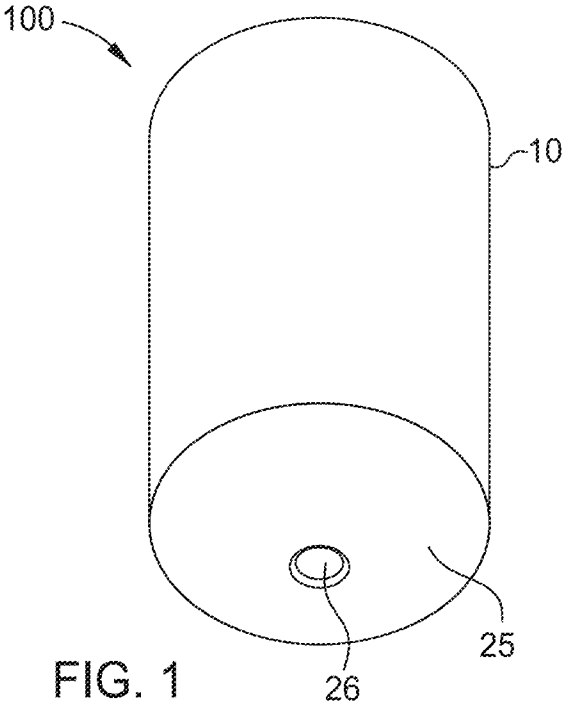
FIG. 1 is a bottom perspective view of a casing shoe assembly, according to one embodiment.
Figure 2:
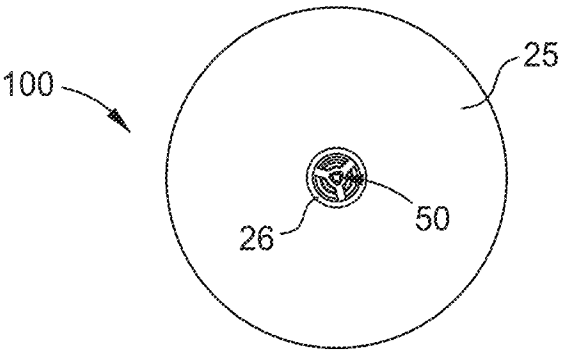
FIG. 2 is a bottom view of the casing shoe assembly, according to one embodiment.
Figure 3:
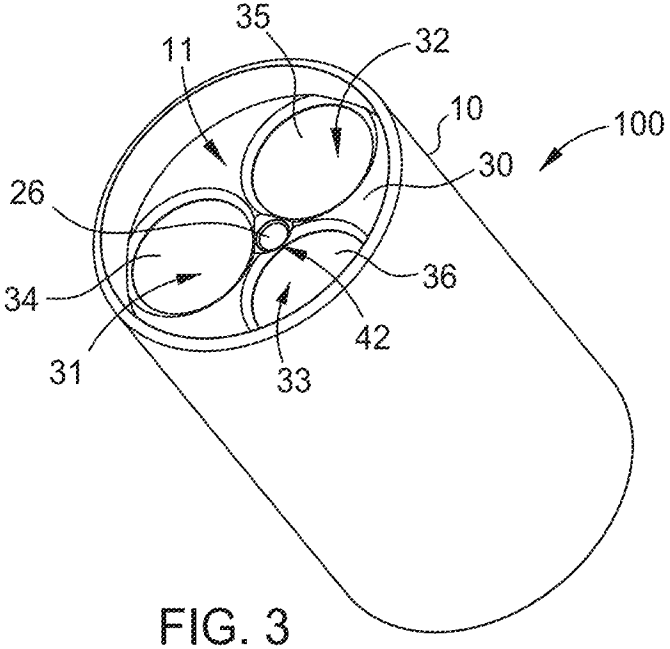
FIG. 3 is a top perspective view of the casing shoe assembly, according to one embodiment.
Figure 4:
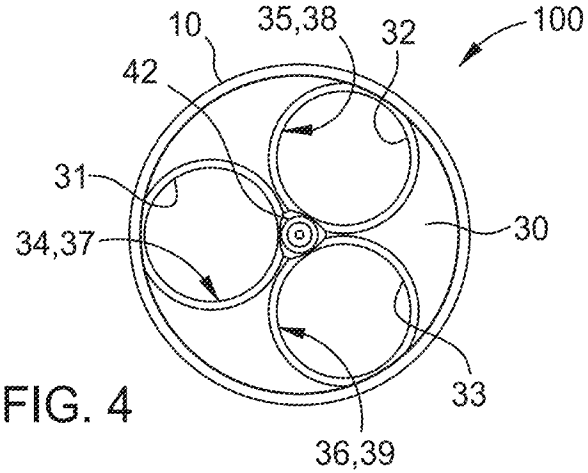
FIG. 4 is a top view of the casing shoe assembly, according to one embodiment.
Figure 5:
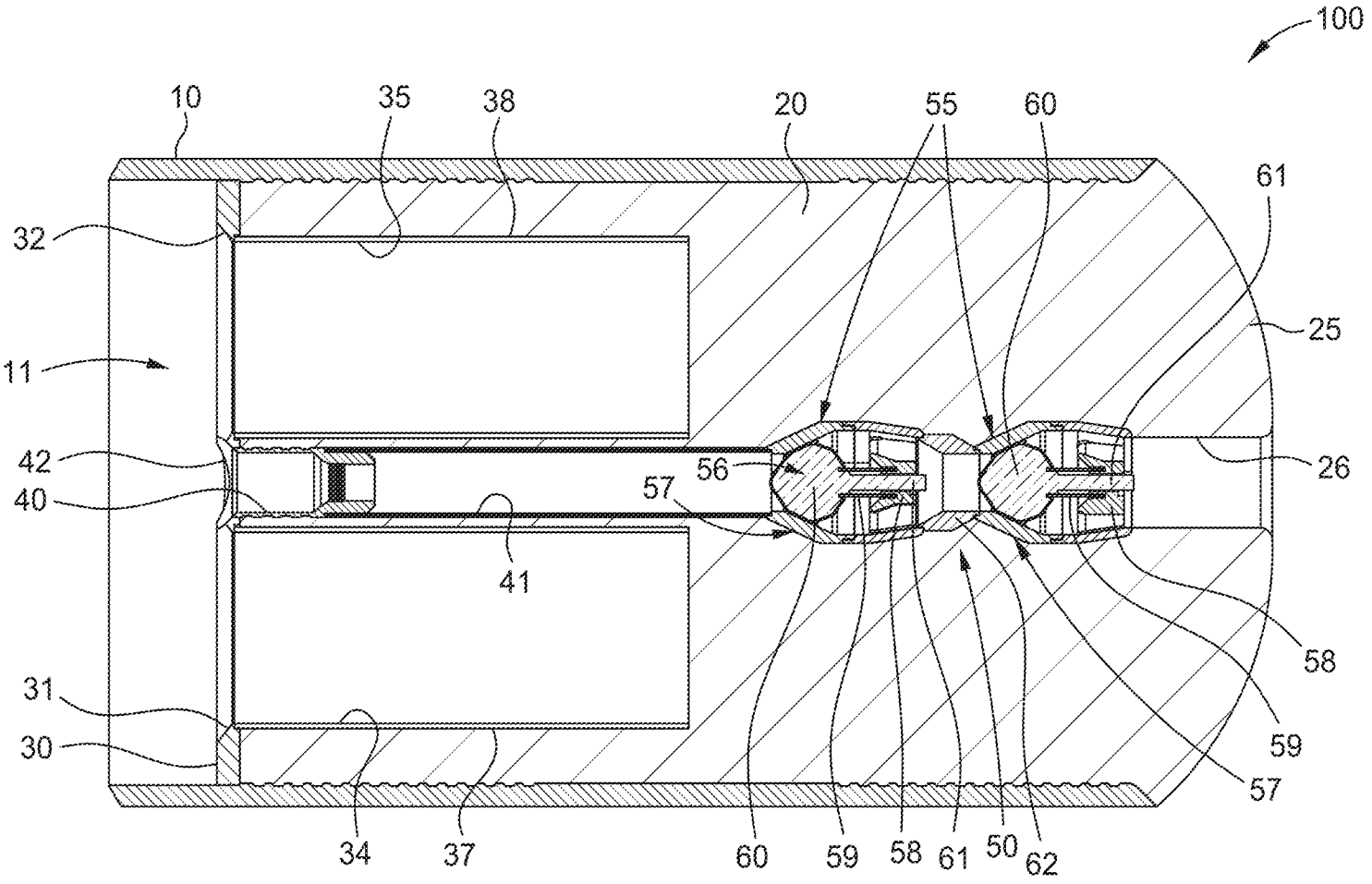
FIG. 5 is a sectional view of the casing shoe assembly, according to one embodiment.

FIG. 1 is a bottom perspective view of a casing shoe assembly 100, according to one embodiment. FIG. 2 is a bottom view of the casing shoe assembly 100. FIG. 3 is a top perspective view of the casing shoe assembly 100. FIG. 4 is a top view of the casing shoe assembly 100. FIG. 5 is a sectional view of the casing shoe assembly 100.

The casing shoe assembly 100 is configured to be coupled to an end of a casing string, lowered into a primary wellbore, and cemented within the primary wellbore. The casing shoe assembly 100 is configured to facilitate the drilling of multiple, uniformly spaced wellbores through the casing shoe assembly 100 as further described below.

With references to FIGS. 1-5, the casing shoe assembly 100 comprises an outer housing 10 having a bore 11 formed through the outer housing 10, and an inner body 20 coupled to and at least partially disposed within the bore 11 of the outer housing 10. The inner body 20 is formed out of a drillable material such as concrete, cement, plastic, and/or metal (e.g. aluminum). The inner body 20 may be at least partially threaded into the outer housing 10. A lower end of the inner body 20 comprises a bull nose 25 that extends out of an end of the outer housing 10. A bore 26 extends through the inner body 20 and the bull nose 25.

The casing shoe assembly 100 further comprises a wellbore guide plate 30 disposed within the bore 11 of the outer housing 10 and positioned on an upper end of the inner body 20. The wellbore guide plate 30 has a first opening 31, a second opening 32, and a third opening 33 formed through the wellbore guide plate 30. Although three openings are shown, the wellbore guide plate 30 can have any number of openings. The openings 31, 32, 33 are uniformly and symmetrically spaced relative to each other but alternatively can be spaced in other orientations.

A first wellbore guide 34, a second wellbore guide 35, and a third wellbore guide 36 are disposed within the bore 11 of the outer housing 10 below the wellbore guide plate 30. The wellbore guides 34, 35, 36 are in the form of hollow cylindrical sleeves that are positioned in holes 37, 38, 39 formed in the inner body 20. The wellbore guides 34, 35, 36 and the holes 37, 38, 39 do not extend through the entire inner body 20. The wellbore guides 34, 35, 36 and the holes 37, 38, 39 are in alignment with and extend below one of the openings 31, 32, 33 of the wellbore guide plate 30.

The wellbore guide plate 30 has a separate opening 42 that is in alignment with the bore 26 that extends through the inner body 20. An optional receiver sub 40 and an optional inner flow sleeve 41 are disposed within the bore 26 of the inner body 20 below the wellbore guide plate 30. The receiver sub 40 may be coupled to the inner body 20, the inner flow sleeve 41, and/or the wellbore guide plate 30.

A check valve assembly 50 is also disposed within the bore 26 of the inner body 20 below the inner flow sleeve 41. The check valve assembly 50 comprises one or more check valves 55 configured to allow fluid flow in one direction through the bore 26 of the inner body 20 and out of the bull nose 25, and prevent fluid flow in the opposite direction back up through the bore 26 from the bull nose 25. The check valves 55 may be coupled to the inner body 20 and/or disposed within recessed portions formed in the bore 26 of the inner body 20.

Each check valve 55 comprises a valve member 56, a valve seat 57, a valve guide 58, and a biasing member 59. The biasing member 59 biases the check valve 55 into a closed position where a plunger portion 60 of the valve member 56 is in sealing engagement with the valve seat 57. The biasing member 59 is positioned between the plunger portion 60 and the valve guide 58. A stem portion 61 of the valve member 56 extends through the valve guide 58. The valve guide 58 also abuts up against and supports a lower end of the valve seat 57. The upper end of the valve seat 57 abuts up against a lower end of the inner sleeve 41. A spacer ring 62 can be positioned between adjacent check valves 55 to support the ends of the check valves 55. Although only one check valve 55 is needed to prevent fluid flow back up through the bore 26 from the bull nose 25, two, three, four, or more check valves 55 may be used as backup valves in the event of failure of the other check valves 55.

Figure 8:
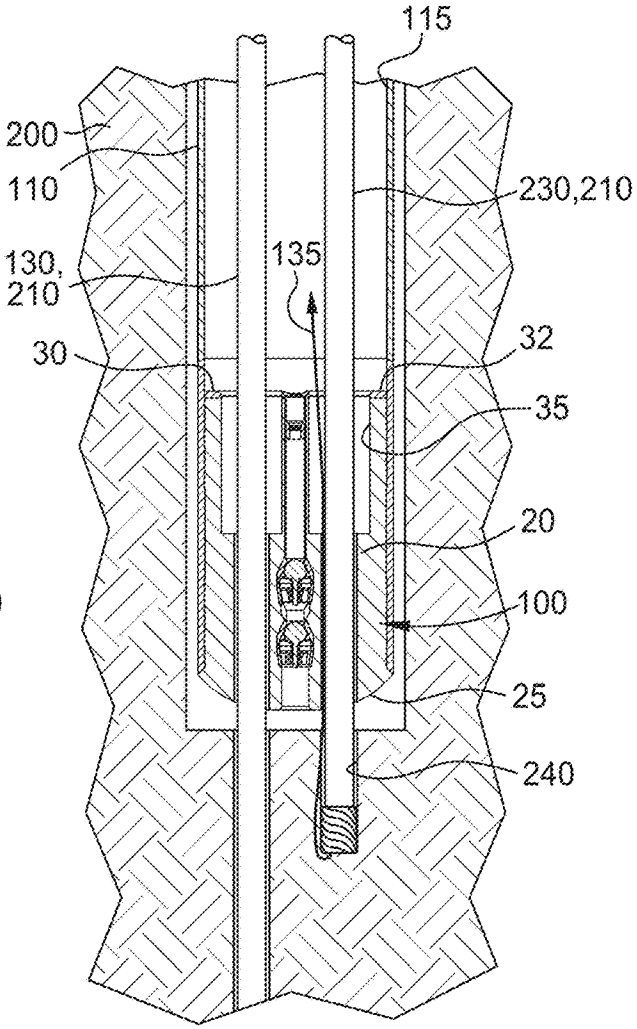
FIG. 8 is a sectional view of the casing shoe assembly in the primary wellbore with a drill string drilling a second wellbore through the casing shoe assembly, according to one embodiment.
Figure 7:
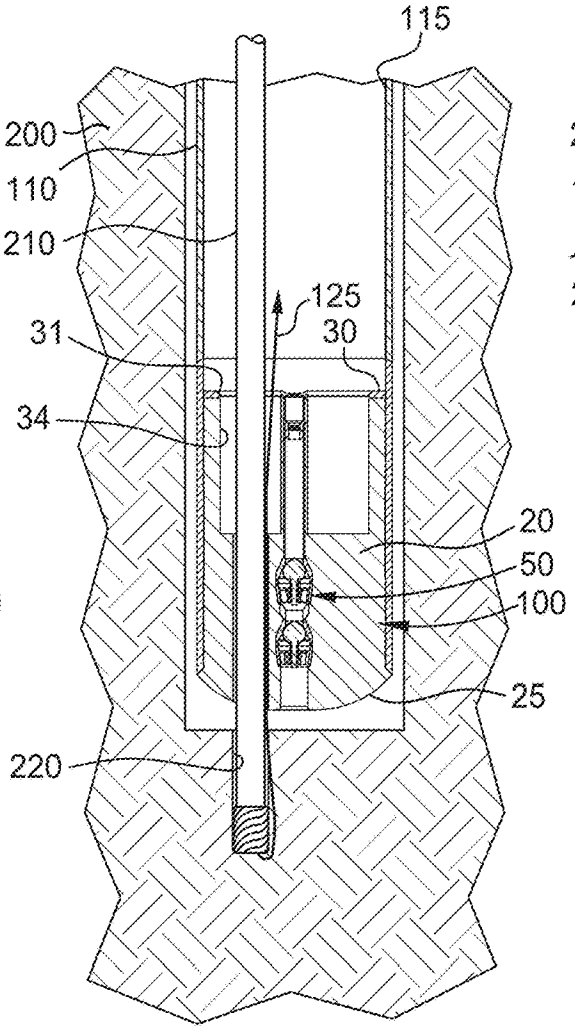
FIG. 7 is a sectional view of the casing shoe assembly in the primary wellbore with a drill string drilling a first wellbore through the casing shoe assembly, according to one embodiment.
Figure 6:
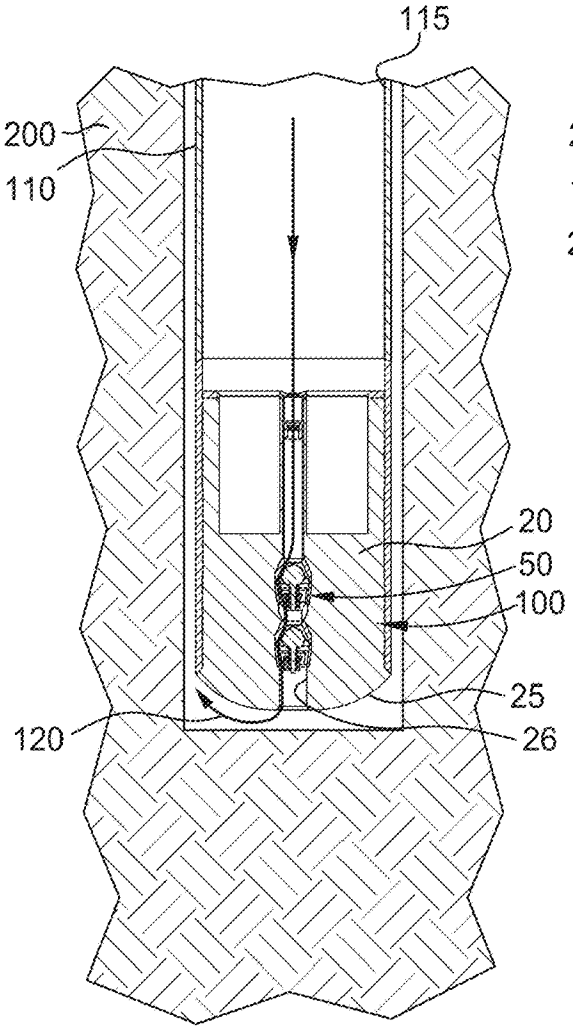
FIG. 6 is a sectional view of the casing shoe assembly in a primary wellbore, according to one embodiment.

FIG. 6 is a sectional view of the casing shoe assembly 100 in a primary wellbore 200, according to one embodiment. FIG. 7 is a sectional view of the casing shoe assembly 100 in the primary wellbore 200 with a drill string 210 drilling a first wellbore 220 through the casing shoe assembly 100, according to one embodiment. FIG. 8 is a sectional view of the casing shoe assembly 100 in the primary wellbore 200 with a drill string 230 (which can be the same as the drill string 210) drilling a second wellbore 240 through the casing shoe assembly 100, according to one embodiment.

With reference to FIG. 6, the primary wellbore 200 has been previously drilled, and a casing string 110 with the casing shoe assembly 100 coupled to the end is lowered into the primary wellbore 200. A fluid 120 can be pumped through the casing string 110 during and/or after the casing string 110 is lowered into the primary wellbore 200. The fluid 120 is pumped down through a bore 115 of the casing string 110, then flows through the separate opening 42 of the wellbore guide plate 30, through the receiver sub 40, through the inner flow sleeve 41, through the check valves 55, through the bore 26 of the inner body 20, and out of the bull nose 25 of the casing shoe assembly 100 into the primary wellbore 200.

The fluid 120 is pumped at a pressure sufficient to move the check valves 55 from the closed positon to the open position against the bias force of the biasing members 59. The check valve assembly 50 allows the fluid 120 to flow through the bore 26 of the inner body 20 and out of the bull nose 25, and prevents the fluid 120 and/or any other fluid in the primary wellbore 200 from flowing up into the bore 26 from the bull nose 25. When the casing string 110 and the casing shoe assembly 100 are in the desired location, the fluid 120 can be cement that is pumped down through the casing shoe assembly 100 and into the primary wellbore 200 to cement the casing string 110 and the casing shoe assembly 100 in the primary wellbore 200.

With reference to FIG. 7, the drill string 210 can be lowered into the casing string 110 and directed into the first wellbore guide 34 via the first opening 31 of the wellbore guide plate 30. Any number of downhole measurement and/or orientation tools can be used to help orient and direct the drill string 210 into the first wellbore guide 34 via the first opening 31 of the wellbore guide plate 30. The drill string 210, further guided by the first wellbore guide 34, drills through and out of the bull nose 25 of the inner body 20 of the casing shoe assembly 100 to drill the first wellbore 220 below the primary wellbore 200.

A fluid 125 can be pumped down through the drill string 210 and circulated back up to the surface through the casing string 110. The fluid 125 can flow up through the portion of the inner body 20 of the casing shoe assembly 100 that was drilled through by the drill string 210. When the first wellbore 220 has been drilled, the drill string 210 can be removed and a casing string 130 (illustrated in FIG. 8) can be subsequently lowered and cemented in the first wellbore 220. Alternatively, the drill string 210 can be a casing string that is used to drill the first wellbore 220 and cemented in place in a single trip without having to remove any drill/casing string from the first wellbore 220.

With reference to FIG. 8, the drill string 230 (which can be the same as the drill string 210) can be lowered into the casing string 110 and directed the second wellbore guide 35 via the second opening 32 of the wellbore guide plate 30. Any number of downhole measurement and/or orientation tools can be used to help orient and direct the drill string 230 into the second wellbore guide 35 via the second opening 32 of the wellbore guide plate 30. The drill string 230, further guided by the second wellbore guide 35, drills through and out of the bull nose 25 of the inner body 20 of the casing shoe assembly 100 to drill the second wellbore 240 below the primary wellbore 200.

A fluid 135 can be pumped down through the drill string 230 and circulated back up to the surface through the casing string 110. The fluid 135 can flow up through the portion of the inner body 20 of the casing shoe assembly 100 that was drilled through by the drill string 230. When the second wellbore 240 has been drilled, the drill string 230 can be removed and another casing string can be subsequently lowered and cemented in the second wellbore 240. Alternatively, the drill string 230 can be a casing string that is used to drill the second wellbore 240 and cemented in place in a single trip without having to remove any drill/casing string from the second wellbore 240.

The method described with respect to FIGS. 7 and 8 can be repeated to drill a third wellbore via the third wellbore guide 36 and the third opening 33 of the wellbore guide plate 30 of the casing shoe assembly 100. The casing shoe assembly 100 can be designed with two, three, four, five, six, or more wellbore guides such that two, three, four, five, six, or more wellbores can be drilled through the casing shoe assembly 100. In this manner, the casing shoe assembly 100 is configured to help drill multiple, robust wellbores from the single primary wellbore 200. The multiple wellbores may be uniformed and/or symmetrically spaced relative to each other.

Any one or more components of the casing shoe assembly 100 may be integrally formed together, directly coupled together, and/or indirectly coupled together, and are not limited to the specific arrangement of components illustrated in FIGS. 1-8.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements. The disclosure also contemplates that one or more aspects of the embodiments described herein may be substituted in for one or more of the other aspects described. The scope of the disclosure is determined by the claims that follow.

The invention claimed is:

1. A casing shoe assembly, comprising:

an outer housing;

an inner body at least partially disposed within the outer housing and formed out of a drillable material, the inner body comprising a bore formed through the inner body;

a check valve assembly disposed within the bore of the inner body and configured to allow fluid flow in one direction and prevent fluid flow in the opposite direction;

a guide plate disposed within the outer housing above the inner body having a plurality of wellbore openings formed through the guide plate and a separate opening formed through the guide plate to provide fluid flow into the bore formed through the inner body; and a wellbore guide located below each wellbore opening of the guide plate and within a hole formed in the inner body, wherein each wellbore guide does not extend through the entire inner body, and each hole has a sidewall that does not extend through the entire length of the inner body.

2. The casing shoe assembly of claim 1, wherein the plurality of wellbore openings formed through the guide plate comprises three uniformly spaced wellbore openings.

3. The casing shoe assembly of claim 2, wherein the separate opening formed through the guide plate is disposed in the center of the guide plate between the three uniformly spaced wellbore openings.

4. The casing shoe assembly of claim 1, wherein the wellbore guides are in the form of hollow cylindrical sleeves.

5. The casing shoe assembly of claim 1, wherein the outer housing is in the form of a hollow cylindrical sleeve.

6. The casing shoe assembly of claim 1, wherein the inner body comprises a bull nose that extends out of one end of the outer housing.

7. The casing shoe assembly of claim 1, wherein the check valve assembly comprises a pair of check valves.

8. The casing shoe assembly of claim 1, further comprising an inner flow sleeve disposed within the bore of the inner body below the separate opening formed through the guide plate guide plate and above the check valve assembly.

9. A method of drilling a wellbore, comprising:

lowering a casing string comprising a casing shoe assembly into a primary wellbore, wherein the casing shoe assembly comprises:

an outer housing;

an inner body at least partially disposed within the outer housing and formed out of a drillable material, the inner body comprising a bore formed through the inner body;

a check valve assembly disposed within the bore of the inner body and configured to allow fluid flow in one direction and prevent fluid flow in the opposite direction;

a guide plate disposed within the outer housing above the inner body having a plurality of wellbore openings formed through the guide plate and a separate opening formed through the guide plate to provide fluid flow into the bore formed through the inner body; and a wellbore guide located below each wellbore opening of the guide plate and within a hole formed in the inner body, wherein each wellbore guide does not extend through the entire inner body, and each hole has a sidewall that does not extend through the entire length of the inner body;

cementing the casing string in the primary wellbore by flowing cement through the casing string, through the bore of the inner body, and out of the casing shoe assembly into the primary wellbore;

lowering a drill string through the casing string;

directing the drill string into a first wellbore opening of the plurality of wellbore openings of the guide plate and through the wellbore guide located below the first wellbore opening;

drilling through the inner body and out of the casing shoe assembly to drill a first wellbore below the primary wellbore;

lowering the same or a different drill string through the casing string;

directing the same or the different drill string into a second wellbore opening of the plurality of wellbore openings of the guide plate and through the wellbore guide located below the second wellbore opening; and drilling through the inner body and out of the casing shoe assembly to drill a second wellbore below the primary wellbore.

10. The method of claim 9, wherein the plurality of wellbore openings formed through the guide plate comprises three uniformly spaced wellbore openings.

11. The method of claim 10, wherein the separate opening formed through the guide plate is disposed in the center of the guide plate between the three uniformly spaced wellbore openings.

12. The method of claim 9, wherein the wellbore guides are in the form of hollow cylindrical sleeves.

13. The method of claim 9, wherein the outer housing is in the form of a hollow cylindrical sleeve.

14. The method of claim 9, wherein the inner body comprises a bull nose that extends out of one end of the outer housing, and wherein drilling through the inner body and out of the casing shoe assembly to drill the first and second wellbores comprises drilling through the bull nose.

15. The method of claim 9, wherein the check valve assembly comprises a pair of check valves, and wherein cementing the casing string in the primary wellbore comprises flowing cement through the bore of the inner body at a pressure sufficient to move the check valves from a closed position to an open position.

16. The method of claim 9, further comprising an inner flow sleeve disposed within the bore of the inner body below the separate opening formed through the guide plate and above the check valve assembly, and wherein cementing the casing string in the primary wellbore comprises flowing cement through the separate opening formed through the guide plate, through the inner flow sleeve, and through the bore of the inner body at a pressure sufficient to move the check valve assembly from a closed position to an open position.

* * * * *